US008061555B2

(12) United States Patent
Guglielmi et al.

(10) Patent No.: US 8,061,555 B2
(45) Date of Patent: Nov. 22, 2011

(54) AUTOMATIC PRODUCT VENDING MACHINE

(75) Inventors: Roberto Guglielmi, Schio (IT); Antonio Scapin, Torrebelvicino (IT)

(73) Assignee: Daint S.R.L., Schio (Vicenza) (IT)

( * ) Notice: Subject to any disclaimer, the term of this patent is extended or adjusted under 35 U.S.C. 154(b) by 745 days.

(21) Appl. No.: 11/989,065

(22) PCT Filed: Jul. 17, 2006

(86) PCT No.: PCT/EP2006/006998

§ 371 (c)(1),
(2), (4) Date: Jan. 18, 2008

(87) PCT Pub. No.: WO2007/009714

PCT Pub. Date: Jan. 25, 2007

(65) Prior Publication Data

US 2009/0152288 A1 Jun. 18, 2009

(30) Foreign Application Priority Data

Jul. 18, 2005 (IT) ..... VI05A0199

(51) Int. Cl.

| | |
|---|---|
| ***G07F 11/00*** | (2006.01) |
| ***B65H 1/00*** | (2006.01) |
| ***B65H 3/44*** | (2006.01) |

(52) U.S. Cl. ..... 221/13; 221/2; 221/253; 221/241; 221/132; 221/119; 221/112; 221/192; 221/121; 221/133; 221/123; 221/75; 194/212; 212/88

(58) Field of Classification Search ..... 221/2, 88, 221/75, 123, 119, 133, 13, 121, 192, 112, 221/132, 241, 253; 194/212; 212/88
See application file for complete search history.

(56) References Cited

U.S. PATENT DOCUMENTS

| | | | | |
|---|---|---|---|---|
| 4,267,942 | A * | 5/1981 | Wick et al. | 221/2 |
| 4,560,088 | A | 12/1985 | Tan | |
| 4,598,810 | A * | 7/1986 | Shore et al. | 194/205 |
| 4,789,054 | A * | 12/1988 | Shore et al. | 194/212 |
| 5,121,854 | A * | 6/1992 | Trouteaud et al. | 221/15 |
| 7,783,379 | B2 * | 8/2010 | Beane et al. | 700/237 |
| 7,789,267 | B2 * | 9/2010 | Hutchinson et al. | 221/211 |
| 7,809,470 | B2 * | 10/2010 | Shoenfeld | 700/243 |
| 7,837,058 | B2 * | 11/2010 | Collins et al. | 221/123 |
| 7,837,059 | B2 * | 11/2010 | Hieb et al. | 221/123 |
| 7,857,161 | B2 * | 12/2010 | Pinney et al. | 221/10 |

(Continued)

FOREIGN PATENT DOCUMENTS

EP 0 577 121 A 1/1994

(Continued)

OTHER PUBLICATIONS

International Search Report.

*Primary Examiner* — Gene O. Crawford
*Assistant Examiner* — Rakesh Kumar
(74) *Attorney, Agent, or Firm* — Bucknam and Archer

(57) ABSTRACT

An automatic product vending machine is provided where the user can withdraw the selected product directly from the machine, the storage area for the products is a rack and the dispensing device of the single product is a frame on which a pusher is mounted which causes the selected product to fall into a tray, which positions the product at an opening which permits its withdrawal by the user.

9 Claims, 5 Drawing Sheets

U.S. PATENT DOCUMENTS

| | | | | |
|---|---|---|---|---|
| 2001/0000610 | A1* | 5/2001 | Johnson | 221/13 |
| 2003/0006241 | A1* | 1/2003 | Johnson | 221/75 |
| 2003/0178435 | A1* | 9/2003 | Yamaguchi | 221/2 |
| 2003/0201275 | A1* | 10/2003 | Tamura | 221/123 |
| 2003/0222091 | A1* | 12/2003 | Gerold et al. | 221/92 |
| 2004/0140317 | A1* | 7/2004 | Forte | 221/123 |
| 2009/0048000 | A1* | 2/2009 | Ade-Hall | 455/566 |

FOREIGN PATENT DOCUMENTS

| | | | |
|---|---|---|---|
| EP | 1 076 320 | A | 2/2001 |
| WO | WO 86/04173 | A | 7/1986 |
| WO | WO 94/25942 | A | 11/1994 |
| WO | WO 00/30961 | A | 6/2000 |
| WO | WO 0030961 | A1 * | 6/2000 |

* cited by examiner

AUTOMATIC PRODUCT VENDING MACHINE

The present finding regards an automatic product vending machine, according to the general part of claim 1.

The automatic product vending machines are by now widespread in many places, from industrial to civilian settings, for example in structures such as train stations, hospitals, schools, and refreshment services of various type where the user can withdraw the desired product directly from the machine.

At the state of the art, there are automatic vending machines on the market which have different technologies, both from a structural and functional standpoint.

In particular, product vending machines are known which foresee a plurality of rotating platforms, subdivided into compartments which, by rotating around their own axis in an appropriate manner, are capable of positioning the preselected product at a small door, which upon opening the user may access the inside of the vending machine and then withdraw the desired product.

Other vending machines foresee the use of rotating spirals, with horizontal or vertical axis, which convey the product in correspondence with an opening which permits its withdrawal by the user.

Whatever the mechanism which moves the products from the storage area to an opening, to make their withdrawal by the user more accessible, the automatic vending machine is essentially composed of a cupboard metallic structure, which constitutes the cover of the machine, equipped with a door that can be opened and is adapted to permit access inside the same vending machine for loading the products to be dispensed and for carrying out maintenance operations.

The drawbacks of the automatic vending machines of known type are numerous, the main one being the considerable size of the containment structure of the vending machine itself, as a consequence of the complexity of the mechanisms necessary to realise the dispensing, as well as the fact that the products to be dispensed do not fully occupy the available space of the storage area.

Another drawback is the complexity of the loading operation of the products into the vending machine.

In fact, if one uses rotating platform vending machines, it is necessary that the operator, with the machine's access door open, precisely positions the products to be dispensed, correctly depositing them in the corresponding sector of the disk so that when the user opens the small withdrawal door, the product can be easily taken; that is, in the case of spiral devices, the operator must correctly insert the products in the gap between two successive spirals, so that when the spiral rotates the product located at the end of the spiral, it falls into the withdrawal zone.

Moreover, for lowering management costs and for making different types of products available for the user in a same machine, every automatic vending machine does not dispense one single product but is prearranged so to be able to dispense a plurality of products, with different qualitative as well as size and shape characteristics.

Such need therefore involves the necessity of having, in the single vending machine, a storage area of the products and a withdrawal device which are easily and rapidly modifiable, so to be adapted for optimal functioning with a wide range of products of different sizes, shapes and weight.

Such drawbacks and such needs cannot be respectively eliminated or satisfied with the vending machines of known type, due to their structural form and/or functioning which is hard to modify if not with operations which require variations of the entire dispensing system, with consequent loss of time along with the need to employ qualified personnel, all to the detriment of the machine productivity.

Object of the present invention is that of making an automatic vending machine which lacks the drawbacks manifested by the similar products of known type.

Further object of the finding is that of making an automatic vending machine with simple construction, minimal maintenance, easy access and rapid product loading.

Further object of the finding is that of making an automatic vending machine where the products to be dispensed are totally visible to the user.

Further object of the finding is that of making an automatic vending machine wherein the loading operations of the products in the storage area and the programming of the machine functioning do not require the use of qualified personnel.

Such objects are obtained with the making of an automatic vending machine which differs from similar apparatuses for the particular conformation of the storage area and the product dispensing device.

Structurally, the automatic vending machine according to the invention is characterised in that the storage area of the products is composed of a simple rack in which both the shelves and the dividing walls which divide the containment cells of the products on each shelf are movable, so that from the combination of the horizontal arrangement of the shelves with the vertical arrangement of the walls, it is possible to obtain on each shelf any cell size so to be able to receive products of any shape or size.

Still structurally, the vending machine according to the finding is further characterised in that the dispensing device of the single product is composed of a frame, on which a pusher is mounted which moves the single selected product outside the support shelf and from a tray which collects the selected product and positions it at an opening, which permits its withdrawal by the user.

Operatively, the frame is equipped with a vertical movement so to position both the pusher and the collection tray perfectly in line with the product selected by the user, while the pusher is equipped with a horizontal movement so to position itself in line with the row containing the aforesaid product.

Further characteristic of the finding consists of the fact that the stroke of the pusher, which operates on the rear part of the row of products contained in a cell, is not placed in relation with the thickness of the product to be unloaded, which therefore permits the possibility to position products of different thicknesses aligned in a row in the same cell, without having to make a complex functioning program.

This is made possible by positioning a position detector on the collection tray, which controls the falling step of the product from the shelf after the push of the pusher, and when the product is completely deposited on the collection tray it sends a signal which stops the stroke of the aforesaid pusher, so that the product immediately following the fallen product remains on the rack.

These and other characteristics of the finding are highlighted by means of the description of one of its possible embodiments, given only as a not limiting example, with the air of the attached drawing tables where:

Figure 3:
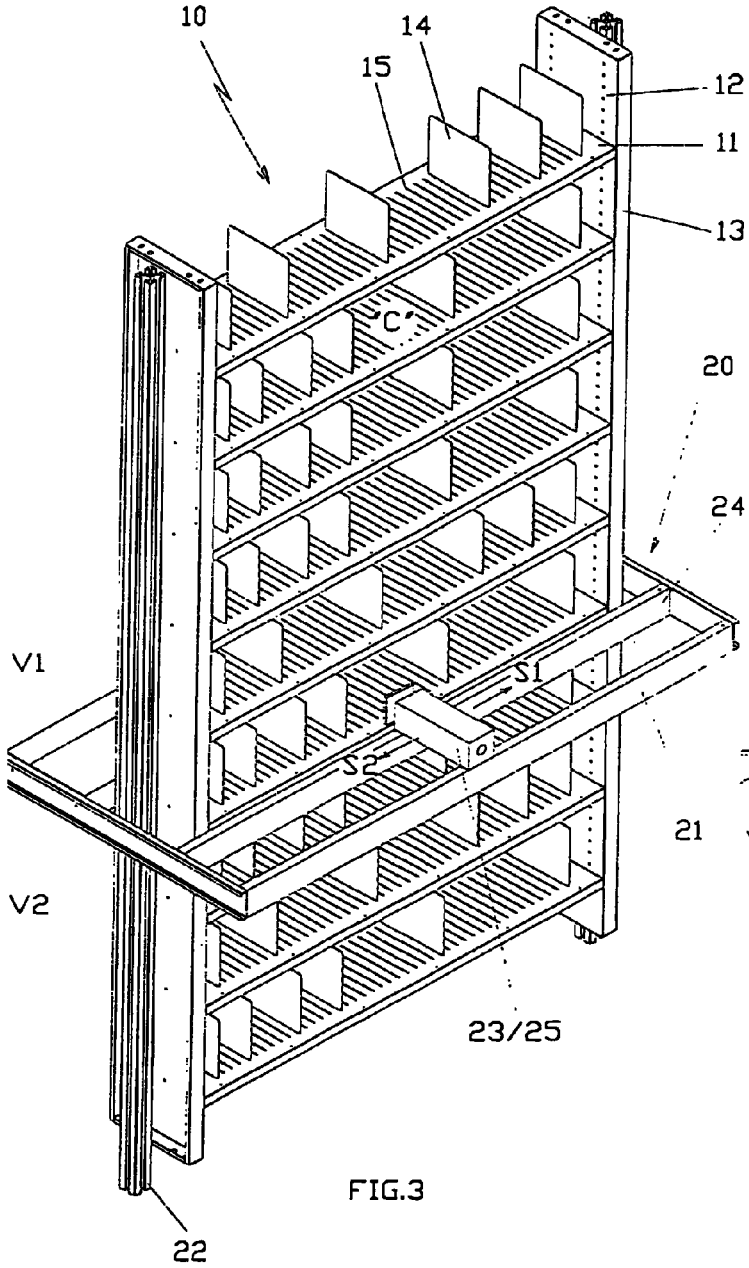
Figure 4:
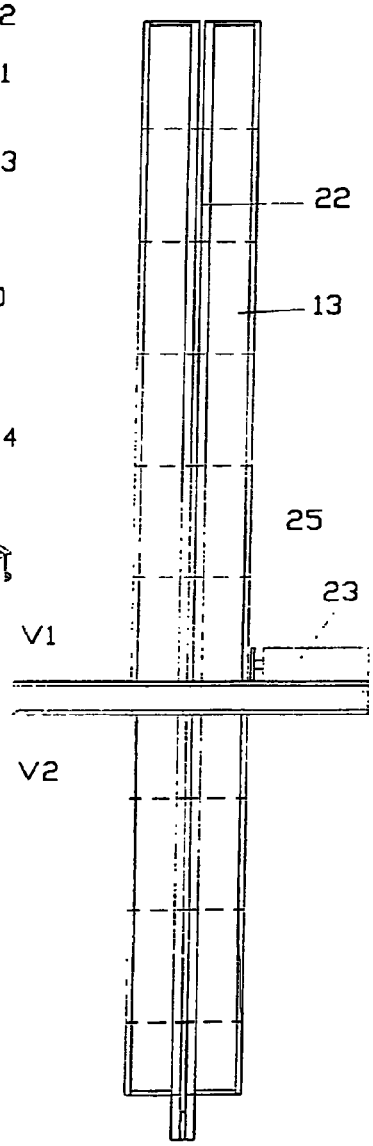
Figure 5:
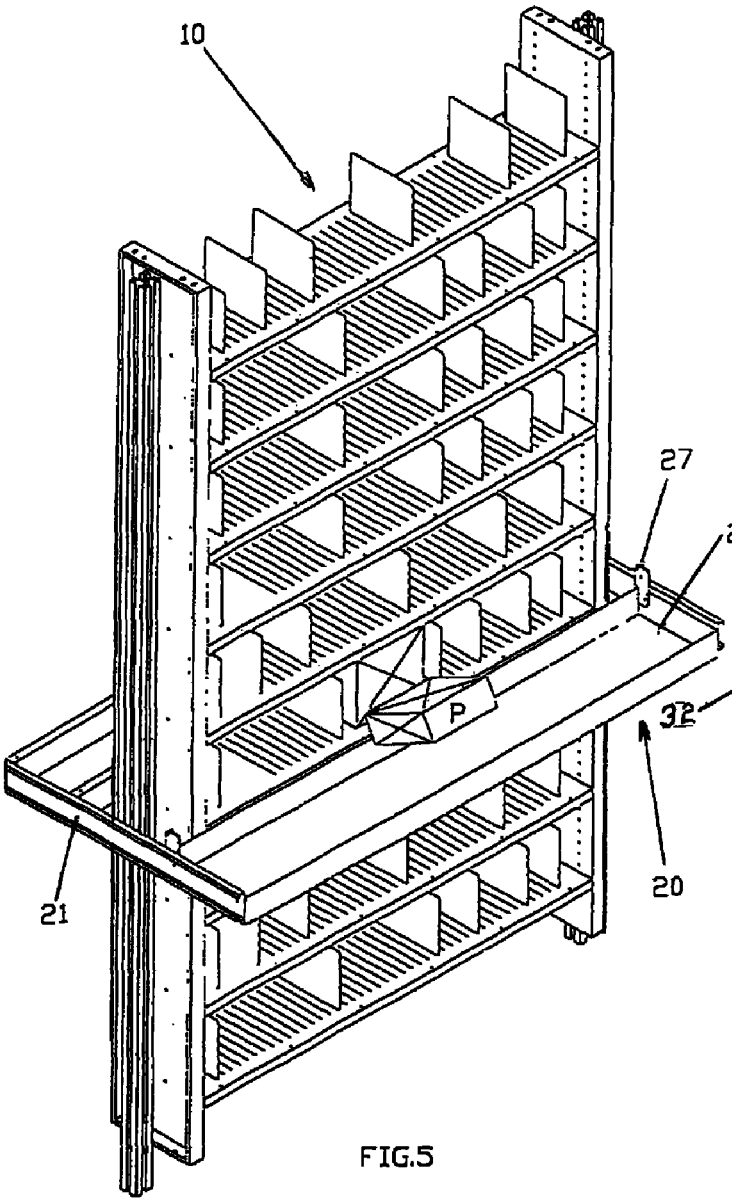
Figure 6:
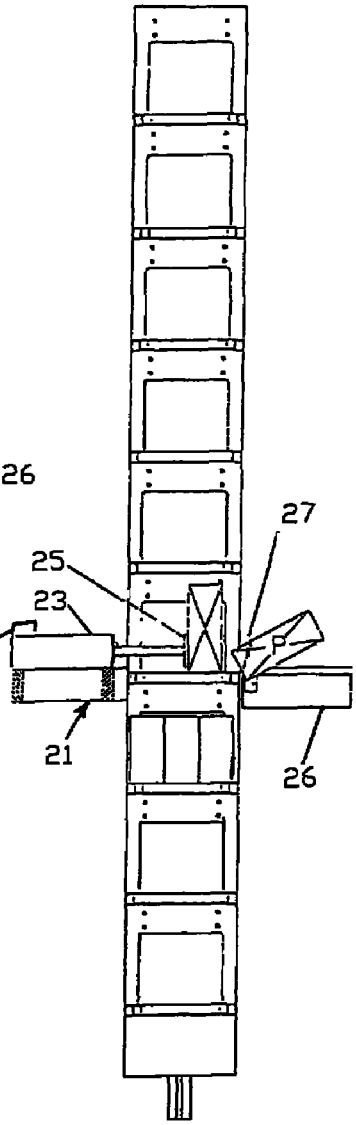

FIGS. 3 and 4 (Table III) respectively represent a rear perspective view and a lateral view of the storage area, in rest conditions;

FIGS. 5 and 6 (Table IV) respectively represent a front perspective view and a lateral view of the storage area, in operating conditions;

FIGS. 7-11 (Table V) represent the working steps of the vending machine according to the finding.

Figure 1:
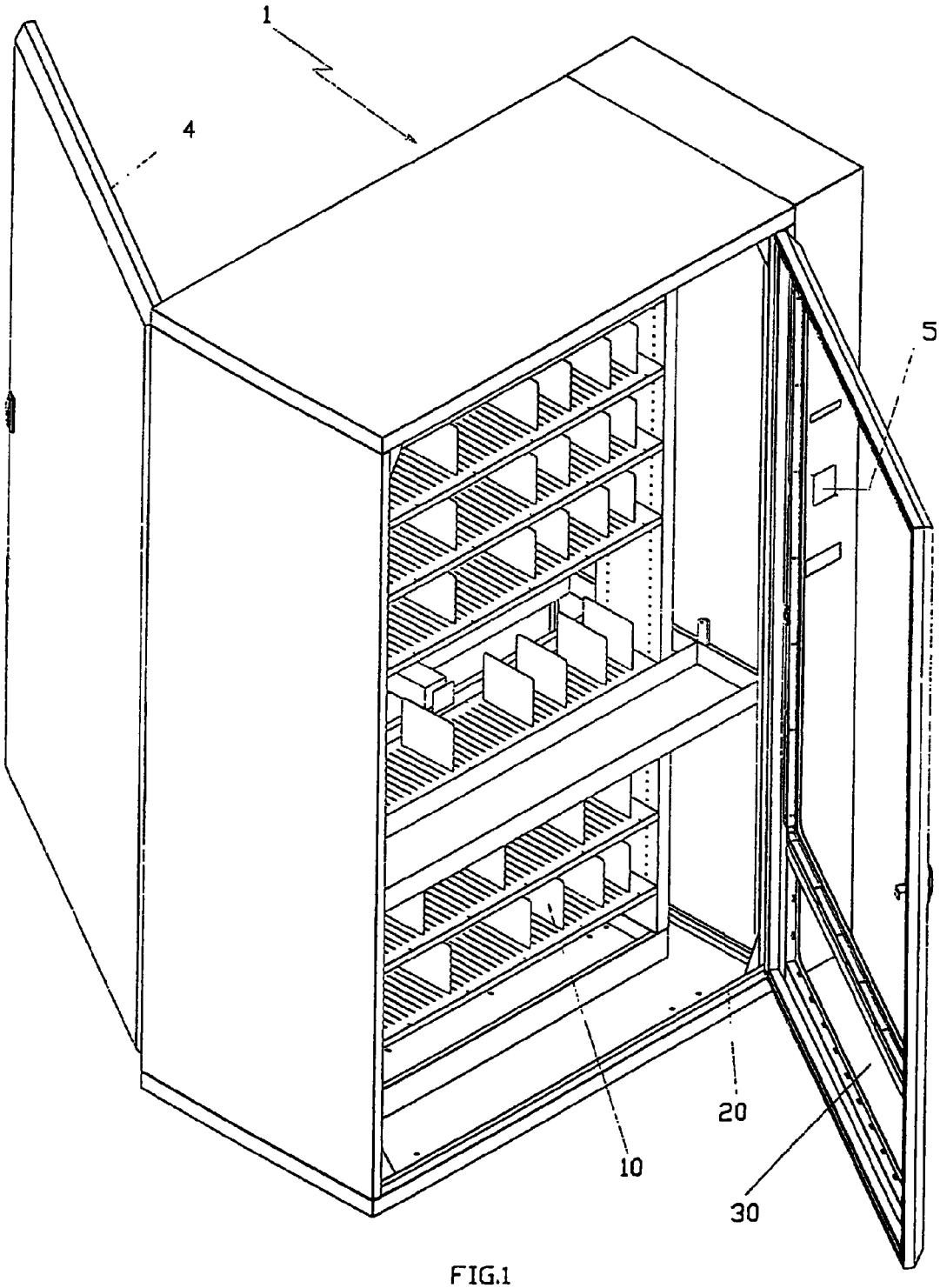
FIG. 1 (Table I) represents a perspective view of the vending machine according to the according to the finding.
Figure 2:
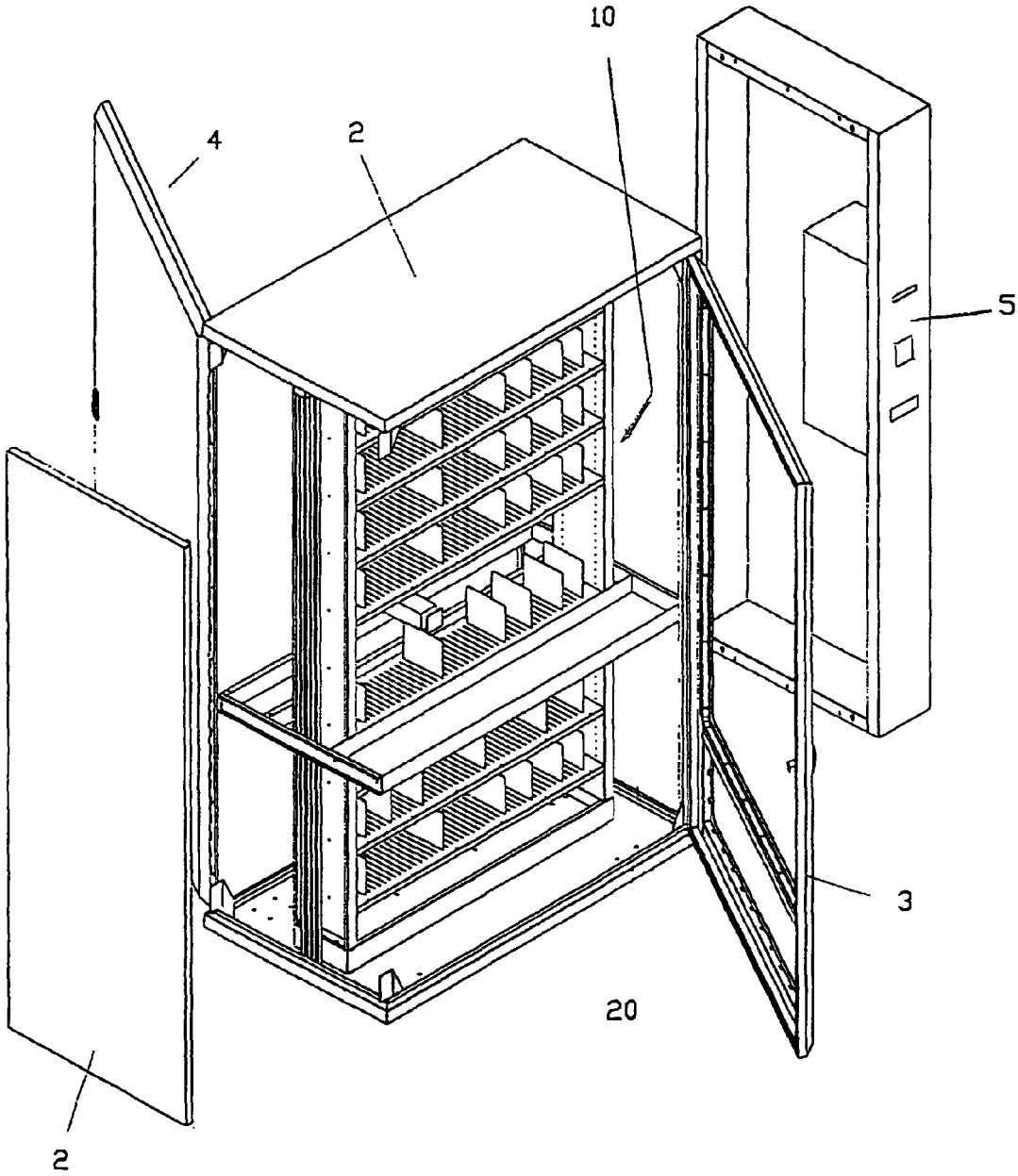
FIG. 2 (Table II) represents an exploded view of the vending machine according to the finding.

As is visible in FIGS. 1 and 2, an automatic vending machine, indicated in its entirety with the reference 1, comprises a cover 2 equipped with front 3 and rear 4 large doors, a push-button panel 5 and contains at its interior the storage area of the products, indicated in its entirety with the reference 10, and a device for moving (unloading) the single product, indicated in its entirety with the reference 20, all according to a in se known general configuration.

As is visible in FIGS. 3-6, the storage area of the products 10 is shaped like a rack, in which the movable shelves 11 can be manually positioned at different heights by means of holes 12 present on the lateral backs 13.

Analogously, movable walls 14 are present on each shelf which can be manually positioned at different distances by means of the slits 15 present on the shelf, so to define "C" cells of different width in relation to the size of the products to be inserted in the specific cell.

The device 20 for moving the product comprises a frame 21 placed outside the storage area 10 and susceptible to vertically slide (see arrows V1, V2) on the guides 22, which are attached to the backs 13.

As is visible in FIGS. 3, 4 in the rear part of the frame 21, a pusher 23 is attached, susceptible to horizontally sliding on the guides 24 (see arrows S1, S2) and equipped with a push plate 25 with horizontal axis.

As is visible in FIGS. 5, 6, in the front part of the frame 21, a tray 26 is present, fixed to said frame and laterally equipped with a detector apparatus 27, such as a photocell or a laser beam, which detects the presence/absence of the product "P" in the unloading step.

The functioning of the vending machine according to the finding is of the "X-Y coordinates" type, since the unloading operation of the product "P" selected by the user on the push-button panel 5 is realised by means of two orthogonal movements, specifically with a vertical movement by means of which the frame 21 is positioned and stopped in line with the shelf which contains the preselected product, and with a subsequent horizontal movement by means of which the pusher 23 is positioned at the row which contains the aforesaid product.

With such orthogonal movements, which are realised with motor members of known type at the state of the art (not claimable) and by means of an operation which defines the coordinates of the stop points of the pusher 23, it is therefore possible to operate on the rear part of the product row so that, with a pushing action, the product which is located in front is caused to fall from the shelf, and is collected by a tray.

Figure 11:
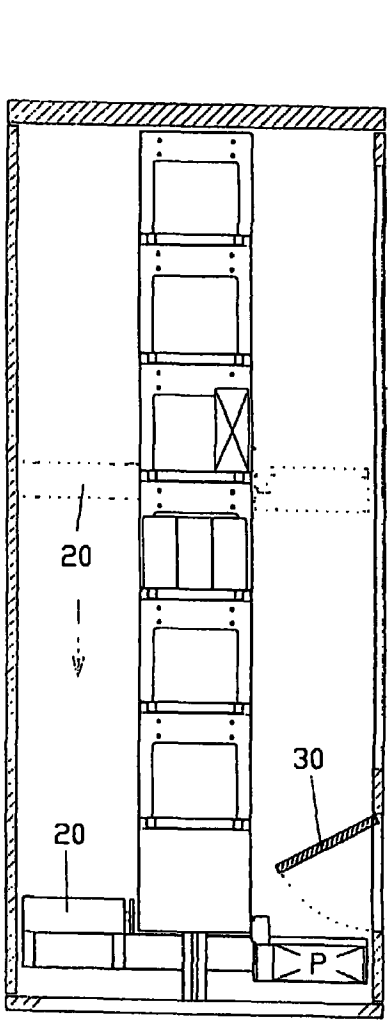
Figure 8:
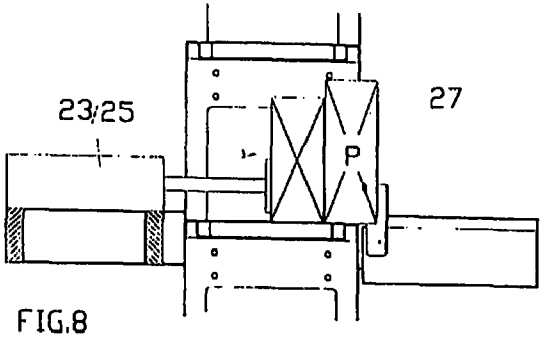
Figure 9:
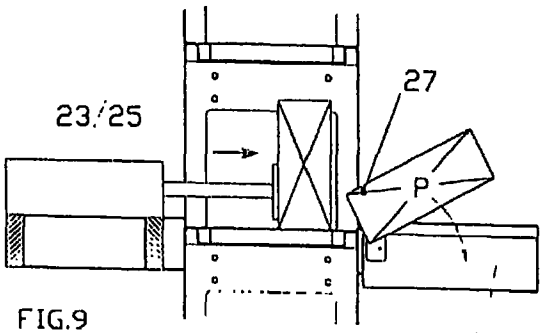
Figure 10:
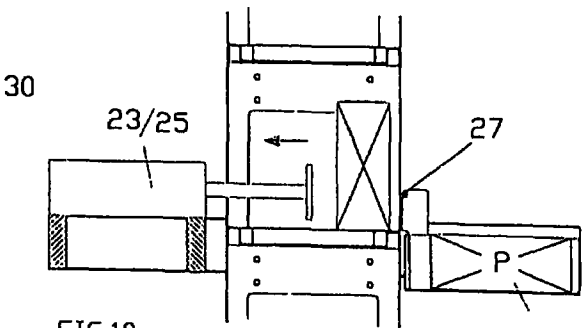
Figure 7:
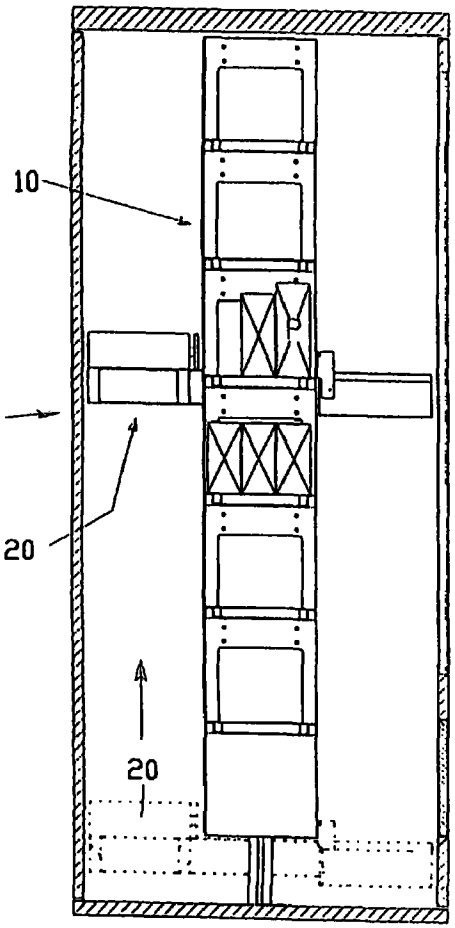

As is visible in FIGS. 7-11, the functioning of the vending machine according to the finding foresees the following steps:

after the user has selected the product on the push-button panel, the frame 21, from the lower rest position, is raised to be brought in correspondence with the shelf 11 containing the product "P", while the pusher 23, with a horizontal movement, is positioned at the row containing the aforesaid product (see FIG. 7);

after the orthogonal positioning, the pusher 23, by means of the release of the plate 25, pushes ahead the row of the products arranged on the shelf, and such movement engages the photocell 27, which detects the projection of the product "P" (see FIG. 8);

the rear pushing action continuing, the product "P", by gravity, is overturned from the shelf, and falls into the collection tray (see FIG. 9);

when the product "P" is totally contained in the tray, the photocell 27, no longer detecting the product "P", blocks the pushing action and the plate returns inside the pusher;

lastly, the frame 21 lowers, positioning the tray 26 at the small door 30 made on the large front door 3, permitting the user to withdraw the requested product (see FIG. 11).

As may be easily inferred from that illustrated, with the vending machine according to the finding it is possible to dispense products of the most varied shapes and sizes which can be inserted in the storage area, both in the front and the back of the same, in always different modes, whether on the different shelves or inside the single cell; this is permitted by the movability both of the shelves 11 and the small walls 14, and by the fact that the stroke of the plate 25 of the pusher 23 is not predetermined and is not directly dependent on the thickness of the products present in the row subjected to the push.

Such considerable versatility of use implies that, after having terminated the configuration of the cells, the operation with which the "self-learning of the pusher" is realised, i.e. the identification of the X-Y coordinates of the stop points of the pusher at each cell, must be executed with considerable precision so to ensure that the plate of the pusher can operate in an optimal manner on all products inserted in that cell.

Such operation can be carried out in a substantially manual or automatic manner.

In the operation of manual self-learning, made possible by the very simplified shape both of the storage area 10 and the product movement device 20, the operator grips the pusher 23 and positions it at each cell "C" in the manner that, at his discretion and for his experience, he deems optimal with respect to the products contained in that cell.

In practice, the operator vertically establishes height of the shelf and horizontally the centring or laterality of the push point of the plate in the area of the cell, and this is memorised in the controller.

Of course such operation is executed every time the size of the cells is modified, or when the type of the products present in a cell is varied.

On the other hand, in the operation of automatic self-learning, the position of the pusher in each cell is defined by equipping the pusher itself with a position detector 32 (see FIG. 6) of both the shelf and the two walls which define the cell, and then applying "default" information, which establishes as push point in the barycentre or a predetermined misalignment value of the cell area, the pusher positions itself and then memorizes such position in the controller.

Of course, embodiments even quite different from that described are possible, as a function of the sizes and components used for the construction of the vending machine or the types of products to be dispensed, without for this departing from the scope of the following claims.

The invention claimed is:

1. A vending machine, of the type wherein a user can withdraw a selected product amongst a plurality of products from the vending machine, said vending machine comprising:

a storage area for the plurality of products consisting of a rack of vertically arranged shelves (11), the shelves being divided into a plurality of cells each of which contains a select number of said plurality of products arranged in a row and wherein said selected product is in a forefront position of one of said plurality of cells; and a dispensing device for dispensing said selected product which includes:

a vertically movable frame (21) having a collection tray (26) arranged in front of said plurality of cells and a horizontally movable pusher (23) with a push plate (25) disposed to act on a hindmost of the select number of said plurality of products contained in said plurality of cells, whereby vertical movement of the vertically movable frame positions the horizontally movable pusher and the collection tray in alignment with the shelf in which the cell containing the selected product is disposed, and transverse horizontal movement of the horizontally movable pusher positions the horizontally movable pusher in alignment with the cell containing the selected product so that the push plate acts on the hindmost of the select number of said plurality of products contained in the cell containing the selected product causing the selected product to fall into said collection tray, and further vertical movement of said vertically movable frame positions the collection tray at an opening from which the selected product can be withdrawn, and a detector device disposed in the collection tray for controlling a stroke of the push plate (25) detects the selected product as it falls into the collection tray and signals the push plate (25) to end its stroke when the selected product is deposited in the collection tray so that an immediately following product in the cell which contained the selected product remains in the cell.

2. The vending machine as defined in claim 1, wherein vertical positioning of the shelves (11) in said rack is adjustable and each cell of the plurality of cells is defined by movable dividing walls so that each cell size is adjustable.

3. The vending machine as defined in claim 1, which further includes a cover (2) having a large front door (3) and a large rear door (4) and a push button panel (5), wherein said storage area for the plurality of products and said dispensing device are contained within said cover (2), and wherein a lateral back (13) is provided to support each end of said vertically arranged shelves (11), each said lateral back (13) having holes (12) so that said shelves (11) can be manually positioned at different heights, and said shelves (11) have a plurality of slits (15) to accommodate walls (14) being manually movable among said slits (15) so as to define different size cells.

4. The vending machine as defined in claim 3, wherein a guide (22) is provided on each lateral back (13) to permit vertical sliding of said vertically movable frame (21) thereon.

5. The vending machine as defined in claim 4, wherein said horizontally movable pusher (23) is mounted on a rear part of said vertically movable frame (21) and is adapted to slide transversely horizontally on guides (24), and said push plate (25) has a horizontal axis.

6. The vending machine as defined in claim 5, wherein said collection tray (26) is fixedly arranged in a front part of said vertically movable frame (21) and has arranged laterally thereon a detector device (27) in the form of a photocell or a laser beam to detect the presence/absence of the selected product.

7. The vending machine as defined in claim 6 which operates with the following steps:

a) after a user has selected a product on the push button panel, the vertically movable frame (21), from a rest position, is raised to be brought in correspondence with the shelf (11) containing the selected product (P) and the horizontally movable pusher (23), with a transverse horizontal movement, is positioned at a row containing the selected product;

b) after X-Y orthogonal positioning, the horizontally movable pusher (23), by means of the release of the push plate (25), pushes against the row containing the selected product thereby engaging the detector device (27) which detects the selected product (P);

c) the pushing action continuing, the selected product (P), by gravity, is overturned from the shelf and falls into the collected tray (26);

d) when the selected product (P) is totally contained in the collection tray, the detector device (27), no longer detecting the selected product, stops the pushing action and the push plate (25) returns into the horizontally movable pusher (23); and e) the vertically movable frame (21) lowers, positioning the collection tray at a small door (30) formed in the large front door (3), permitting the user to withdraw the selected product.

8. The vending machine as defined in claim 7, wherein a self-learning operation of the horizontally movable pusher (23), i.e. the identification of the X-Y coordinates of the stop point of the horizontally movable pusher at each cell, occurs manually with an operator who grips the apparatus and at every cell positions it in the manner which the operator deems optimal with respect to the products contained in each cell, and memorizes the position in a controller.

9. The vending machine as defined in claim 7, wherein a self-learning operation of the horizontally movable pusher (23), i.e. the identification of the X-Y coordinates of the stop points of the horizontally movable pusher at each cell, occurs automatically by equipping the horizontally movable pusher with a position detector of both the shelf and the two walls which define the cell, and then, applying "default" information which establishes as push point the barycentre or a predetermined misalignment value of the cell area, the horizontally movable pusher positions itself and then memorizes such position in a controller.

* * * * *